United States Patent [19]

Skala

[11] Patent Number: 4,764,758

[45] Date of Patent: Aug. 16, 1988

[54] INCIPIENT FIRE DETECTOR II

[75] Inventor: George F. Skala, Voorheesville, N.Y.

[73] Assignee: Environment/One Corporation, Schenectady, N.Y.

[21] Appl. No.: 68,530

[22] Filed: Jul. 1, 1987

[51] Int. Cl.[4] ..... G08B 21/00

[52] U.S. Cl. ..... 340/627; 340/632; 340/628; 340/515; 340/516; 73/204; 73/865.5; 73/863.01; 73/23; 356/37

[58] Field of Search ..... 340/627, 628, 632, 507, 340/514, 515, 518, 516, 606; 73/23, 29, 28, 30, 863, 863.01, 863.02, 863.03, 863.21, 865.5, 1 G, 204; 324/464, 465, 468; 356/37; 374/54

[56] References Cited

U.S. PATENT DOCUMENTS

| | | | |
|---|---|---|---|
| 3,678,487 | 7/1972 | Ludewig, Jr. et al. | 340/507 |
| 3,694,085 | 9/1972 | Rich | 356/37 |
| 3,850,040 | 11/1974 | Orr, Jr. et al. | 73/865.5 |
| 4,194,191 | 3/1980 | Salem | 340/515 |
| 4,532,814 | 8/1985 | Lalin | 73/863.23 |
| 4,608,556 | 8/1986 | Cole | 73/863.01 |

*Primary Examiner*—Joseph A. Orsino
*Assistant Examiner*—Jill D. Jackson
*Attorney, Agent, or Firm*—Charles W. Helzer

[57] ABSTRACT

An improved incipient fire detector that employs a sub-micrometer size particle detector of the Wilson cloud chamber type in conjunction with a continuous on-the-fly sequential selector valve assembly and sample gas conduit system for monitoring a plurality of different enclosed spaces (zones). The sampling line for each zone can have up to ten heads, and delivers air or other gaseous atmosphere samples from the respective parts of the zone to the centrally located particle detector at a continuous flow rate of about 14 liters a minute. Each zone line is sampled sequentially by an electronically controlled selector valve assembly for a 15 second interval, once a minute. The cloud chamber particle detector operates at a cycling rate of about once per second and provides a continuous analog voltage corresponding to small particle concentration in the portions of the zone being sampled. The alarm sensitivity can be different for each zone and can be changed with time by means of an external timer to provide increased sensitivity at night, for example. A pre-alarm warning is provided for each zone with the alarm and warning states indicated by separate lights and alarm contact closures for each zone located at a centrally located control panel. The IFD incorporates several diagnostic circuits to monitor its operation, and in case of a problem a trouble indication is provided together with an indication on a diagnostic panel which shows the source of the problem.

28 Claims, 3 Drawing Sheets

10
ZONE #1
ZONE #2
ZONE #3
ZONE #4
25
26
3
17
24
16
GAS SAMPLE BLOWERS
12
28
27
23
3
SELECTOR VALVE MANIFOLD
13
21
SELECTOR VALVE CONTROL CIRCUIT
TIMING CONTROL CIRCUIT
22
33
38
32
44
PARTICLE GENERATOR
45
20
VACUUM PUMP
34
18
43
46
HUMIDIFIER
37
AC POWER
47
30
57
52
53
54
56
CLOUD CHAMBER ROTARY VALVE DRIVE
51
55
14
CLOUD CHAMBER PARTICLE DETECTOR
15
11
19
29,31
FLOW CKT.
SENSOR/ALARM/ TROUBLE CIRCUITS

ALARM CONTACTS CLOSE IF IN THIS AREA > 9 SECONDS
ALARM LEVEL
NORMAL RANGE
TROUBLE LEVEL
TROUBLE CONTACTS CLOSE IF IN THIS AREA > 19 SECONDS
INJECTED PARTICLES
35
36
11 SECONDS
4 SECONDS
TIME

+15V
R1 1.5K

R2 10K
26
SENSOR OUTPUT
27
R3 10K
R4 1.5K
-15V 25
26
17
24
23
28
27

+15V

INPUT FROM SENSOR
29
R6 50K
OUTPUT
31
R5 620
R7 150K
-15V

INCIPIENT FIRE DETECTOR II

TECHNICAL FIELD

This invention relates to the field of fire detectors and particularly to ultra-sensitive fire detectors capable of sensing incipient fire conditions evidenced by the build-up of large small particle concentrations due to high temperatures, the existence of electric arcs, and like conditions which if allowed to exist for any prolonged period of time could lead to open combustion and a full-fledged fire.

BACKGROUND PRIOR ART

U.S. Pat. No. 3,678,487—issued July 18, 1972 for a "Multi-Zone Incipient or Actual Fire and/or Dangerous Gas Detection System"—F. A. Ludewig and F. W. Van Luik—inventors, assigned to Environment/One Corporation of Schenectady, N.Y. (the assignee of the subject invention), describes and claims a multi-zone detecting system for incipient or actual fires and/or dangerous accumulations of potentially explosive gases. This known and proven incipient fire detector system is capable of monitoring the gaseous atmospheres of a number of different volumetric spaces (identified as zones) with a novel, sample-on-the-fly air sampling system that employs a selector valve assembly and sample gas conduit sub-system for continuously and sequentially supplying samples of the gaseous atmospheres from each of the zones being monitored to a centrally located particle detector of the Wilson cloud chamber type.

SUMMARY OF INVENTION

The present invention provides an incipient fire detector of the type disclosed in U.S. Pat. No. 3,678,487 out which includes a number of improved structural and operating features and advantages that make the incipient fire detector (hereafter referred to as IFD) simpler to install and operate and more reliable in operation. Because of these new features and advantages, the improved IFD in operation is less affected by high air velocity, dust, humidity and a wide range of temperature variation, and is less susceptible to the production of false trouble signals. Further, the improved IFD features render it particularly suitable for use in low particle background environments such as clean rooms, computer rooms, and the like.

In practicing the invention, a new and improved incipient fire detector is provided which has a sample gas selector valve and conduit system for selectively sampling the gaseous atmospheres in a multiplicity of different volumetric spaces (zones) automatically on a sequential basis and supplying the sample gases to a centrally located particle detector. The gaseous atmosphere sampling conduit system includes an improved gas flow rate deviation detector which operates in a stable manner over a wide range of temperatures to detect any variations in flow rate of the sampled gases through the sampling conduit system from a preset norm. In addition, the improved IFD includes a system operating condition checking sub-system comprised by a small particle generator connected to the automatically operated sample gas selector valve and conduit system for sequentially supplying samples of the gaseous atmospheres in each of the zones to a centrally located particle detector type sensor and that periodically operates to sequentially sample and test the sample gases from the respective zones for the presence of small particles. Timing and control means are coupled to the particle generator and synchronized with the operation of the respective zone sampling periods for activating the particle generator for a short time interval at the end of the sampling period of each respective zone for injecting into the sample conduit system for delivery to the centrally located particle detector a burst of particles for detection whereby continued normal operation of the system is indicated even in low particle background environments such as a clean room.

The improved IFD further preferably employs a centrally located particle detector of the Wilson cloud chamber type which has an improved inlet and outlet cloud chamber valving system for sequential supply of the gaseous samples from the respective zones to the cloud chamber for detection of small particles therein. The improved inlet and outlet valving system for the Wilson cloud chamber detector comprises a first cloud chamber inlet valve for supply of gas samples to the cloud chamber through a humidifier via the sample gas selector valve and gas conduit system. The valving system further includes a second cloud chamber inlet valve by-passing the first cloud chamber inlet valve and the humidifier, a first cloud chamber outlet valve in series with a flow restriction intermediate the output from the cloud chamber and the cloud chamber vacuum pump, and a second cloud chamber outlet valve by-passing the first cloud chamber outlet valve and series connected flow restriction.

BRIEF DESCRIPTION OF DRAWINGS

These and other objects, features and many of the attendant advantages of this invention will be appreciated more readily as the same becomes better understood from a reading of the following detailed description, when considered in connection with the accompanying drawings, wherein like parts in each of the several figures are identified by the same reference characters, and wherein.

BEST MODE OF PRACTICING INVENTION

Figure 1:
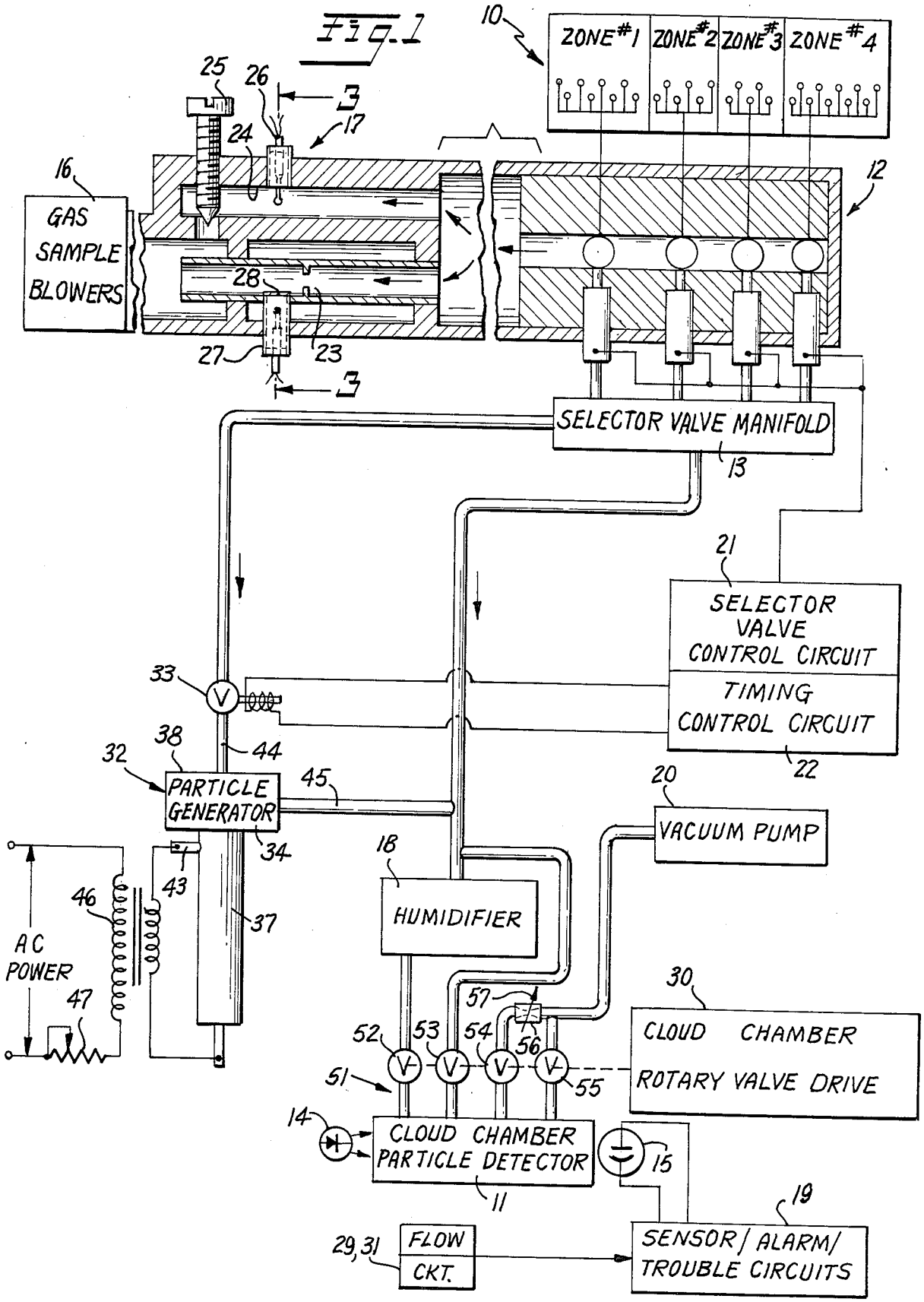
FIG. 1 is a schematic partial sectional view and functional block diagram of an improved incipient fire detector constructed in accordance with the invention.

The improved incipient fire detector shown in FIG. 1 is designed to monitor a number of different (4 in the example now disclosed) zones as indicated at 10 using a submicrometer size particle detector based on the Wilson cloud chamber principle and shown generally at 11 in FIG. 1. A sampling line for each zone, which can have up to ten sample air pickup heads connected to it, delivers air samples thus derived through a selector valve assembly, shown generally at 12, via a manifold 13 to a centrally disposed, common particle detector 11. The sampling system which is comprised by the sample air pickup heads and their interconnected supply conduit sysem and selector valve assembly 12, delivers air to be monitored to the selector valve 12 at a continuous flow rate of about 14 liters a minute for each zone. Each zone is sampled sequentially by the electronically controlled selector valve assembly 12 for 15 seconds, once a minute. The cloud chamber detector 11 operates at a cycling rate of about once per second, and provides a continuous analog output signal voltage whose magnitude corresponds to the particle concentration in the air samples being monitored. In the event that the concentration of small particles in a sample exceeds a predetermined alarm level, then an alarm output signal will be produced as will be explained hereafter with relation to FIG. 2. Further, while the sample atmospheres being sampled have been described as air, it is believed apparent to those skilled in the art that the atmospheres being sampled could be any known gases including potentially dangerous and explosive gases, such as hydrocarbon gases.

The alarm sensitivity can be made to be different for each zone and can be changed with time by means of an external timer to provide increased sensitivity at night, for example. A pre-alarm warning also can be provided for each zone with the alarm and the warning states indicated by separate lights on a central control panel 19 shown in FIG. 1 that can be mounted some distance away from the centrally disposed particle detector 11. The IFD control panel 19 also incorporates several diagnostic circuits to monitor operation of the IFD and in the case of a problem caused by a part or equipment failure, or the like, a trouble signal is produced which can open and/or close different sets of contacts to indicate the source of the problem to an operator of the IFD.

The small particles detected by the IFD are produced in very large numbers as material is heated, or by electric arc, or the like, even before visible smoke is produced. Being of submicrometer size and smaller than the wavelength of light, such particles are invisible even at high concentrations. A room can contain hundreds of thousands of small particles per cubic centimeter, and the air in that room still will appear perfectly clear. In preferred Wilson cloud chamber particle detector 11 the sampled air is humidified and expanded. The expansion cools the humidified air and causes water to condense on the particles as centers of condensation, forming water droplets which are detected by an optical system including an LED light source 14 and photocell detector 15. The photocell 15 provides an output continuous analog signal whose amplitude corresponds the to particle concentration of the small particles contained in the samples being monitored.

For a more detailed description of the construction and operation of the prior known IFD, which is similar in many respects to the new and improved IFD comprising the present invention, references is made to the above-noted U.S. Pat. No. 3,678,487, the disclosure of which hereby is incorporated into the disclosure of this application in its entirety.

Briefly, however, in the IFD shown in FIG. 1, sample gas or air flow is provided by two centrifugal air blowers 16 whose suction intake is coupled via the selector valve assembly 12 and a suitable tubing or piping conduit system, which may be made of either metal or plastic and that is coupled via the selector valve assembly 12 to the several heads in each of the zones 10 being monitored. The blowers 16 continuously draw about 56 liters per minute (14 liters per zone for four zones) through the selector valve assembly 12 on a continuous basis. The sampled gaseous atmospheres from all of the zones are drawn by blower 16 through the sample air conduit system and the selector valve assembly 12 past a flow deviation detector (shown generally at 17 and to be described more fully hereafter), and thereafter discharged to the atmosphere.

During operation of the IFD, an electro mechanical valve for each of the zones which comprise the selector valve assembly 12, opens sequentially, each for 15 seconds under the control of a selector valve control circuit 21. This allows a small part of the sample air from each zone to be sampled on-the fly and supplied via the selector valve manifold 13 to the inlet valving system (to be described more fully hereafter with relation to FIG. 8) of the Wilson cloud chamber particle detector 11. A vibrator type vacuum pump 20 maintains a vacuum reservoir at about 8 inches of mercury below atmosphere pressure at the outlet end of the Wilson cloud chamber particle detector 11 for drawing off the samples thus extracted via the selector valve manifold.

Air samples supplied from the selector valve manifold 13 are delivered to the cloud chamber particle detector 11 initially through a humidifier 18 and thence into the cloud chamber. After a short dwell period (as will be explained more fully hereafter) a first outlet valve of the cloud chamber including a flow restrictor is selectively opened by a rotary valve drive 30 to the vacuum at the outlet end of the cloud chamber 11. As a result, the sample is expanded and cools, and moisture condenses on particles contained in the sample forming tiny droplets of water. The cloud chamber has a light emitting diode 14 light source at one end and a photocell 15 at the other, which measures the concentration of cloud droplets thus formed in the cloud chamber by changes in light intensity. As the rotary inlet and outlet valving system turns, the inside of the cloud chamber is flushed at a rate of about once a second. The water level for the humidifier is monitored by a thermistor which causes a refill solenoid valve to open whenever the water level in the humidifier drops below a preset level (not shown).

The output electric signals from photocell 15 are processed by circuits on the control panel board 19. The selector valves that comprise the selector valve assemoly 12 and that are solenoid controlled, are in turn controlled by a suitable selector valve control circuit 21. Timing control circuit 22 controls the timing of operation of a particle generator 23 to be described hereafter. When warning or alarm levels are reached as a consequence of increased concentration of small particles in one or more of the zones being monitored, appropriate relays will be energized depending upon which zone is being sampled. A time delay of about 7 seconds, and a 2 second blanking interval which resets the time delay at the beginning of each sampling interval, prevents an alarm signal on one zone from affecting the next zone. The alarm relay, if set, will remain energized until a reset button is pushed.

Figure 4:
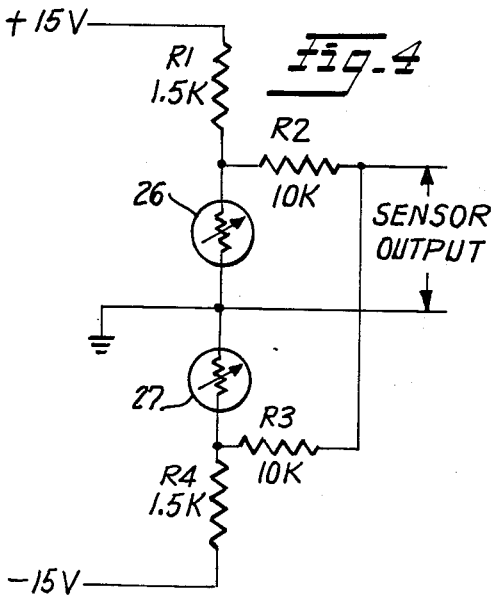
FIG. 4 is a schematic circuit diagram of a measurement circuit used with the thermistor flow sensors shown in FIGS. 3.
Figure 3:
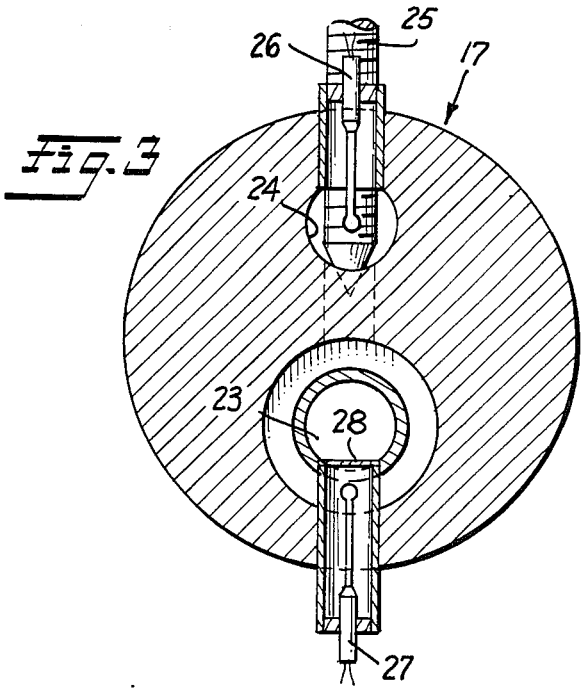
FIG. 3 is a partial sectional view of a novel thermistor type flow sensor employed in the IFD shown in FIG. 1 and constructed in accordance with the invention.

The portion of the sample gas flow not selectively diverted by selector valve assembly 12 into the collector valve manifold 13 for supply to particle detector 11, exits the selector valve assembly 12 through the flow sensing arrangement pictured to the left of the selector valve assembly 12 and which includes the flow rate deviation detector 17 that is further illustrated in FIGS. 3 and 4 of the drawings.

The flow rate deviation detector 17 is defined by a portion of the sample gas conduit system that is formed by an extension of the housing in which the solenoid actuated selector valve assembly 12 is mounted. This housing extension forms a main sample gas flow passageway 23 and a by-pass sample gas flow passageway 24 within which a flow adjusting screw 25 is threadably secured. By threading the adjusting screw 25 in or out the proportion of the sample gas which is caused to flow through the by-pass passageway 22 can be readily set.

As best shown in FIG. 3, the sample gas flow deviation detector 17 is comprised by a set of self-heated thermistors 26 and 27 which are commercially available devices manufactured and sold by a number of semiconductor manufacturers. The thermistor 26 is disposed so that the portion of the sample gas flow diverted through by-pass passageway 24 flows over and past the active end of the thermistor. In contrast, the self-heated thermistor 27 is disposed within an enclosed space closed by a thin conductive tube 28 shown in FIG. 1 and FIG. 3 so that its active element is not exposed to the flow of sample gas past it, but it is located so that it can sense the ambient temperature of the sample gas without being affected by the flow rate of the gas. Similar arrangements have been used for some time in the past employing two similar thermistors; however, such known arrangements are useful over limited temperature ranges, and often require frequent adjustment. The design shown in FIGS. 1 and 2 differs from the past arrangements however in that the thermistors 26 and 27 have different thermal characteristics. For example, thermistor 26 may have a resistance of 4,000 ohms at 25 degrees C., and a free air dissipation constant of 0.6 MW/degrees C. Thermistor 27, on the other hand, while it also has a resistance of 4,000 ohms at 25 degrees C., its bead is larger and its free air dissipation constant has a value of 1.0 MW/degrees C. As noted above, thermistor 26 is mounted so that it is in the moving air stream whose flow is to be monitored, while thermistor 27 is not in the moving air stream, but it is located in a region that is at the same temperature as the flowing air stream.

Assuming the above-stated parameters, it can be demonstrated that the dissipation constant of thermistor 26 is 1.0 MW/degrees C. when it is in an air stream moving at a velocity of 0.63 meters/second. Therefore, at this air velocity the output of the measurement circuit shown in FIG. 4 of the drawings will be zero because both thermistors will be losing heat at the same rate and the voltage across each will be the same. Because the dissipation constants depend on the physical structures of the two thermistors, and are independent of temperature, the output of the sensor circuit shown in FIG. 4 will be zero at a design flow rate setting of 0.63 liters/-second, regardless of the temperature of the sample air. However, because of the large change in thermistor resistance with temperature, the rate of change of sensor output as a function of flow will tend to vary with temperature. For many applications where it is only required to detect whether flow exceeds a specified value, the circuit of FIG. 1 is all that would be required.

Figure 5:
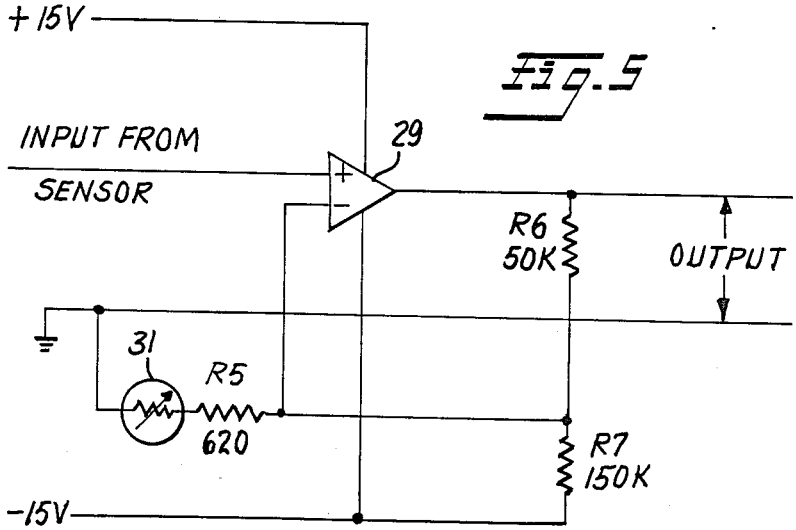
FIG. 5 is a schematic circuit diagram of an output amplifier circuit employed with the circuit of FIG. 3 at the output of the IFD for the purpose of rendering the overall IFD output less sensitive to variations in ambient operating temperature.

For use in the IFD of FIG. 1, however, the amplifier circuit shown in FIG. 5 of the drawings has been added. This circuit incorporates a bias through its design so that its output will be approximately 5 volts when the input to the differential amplifier 29 is zero. This will result in producing a mid-scale reading on the IFD meter mounted in panel 19 when the sample gas flow is correct and at the design flow rate setting. A third thermistor 31 has been added to vary the gain of the output amplifier circuit shown in FIG. 5 as a function of temperature to compensate for the varying gain of the sensor circuit shown in FIG. 4 due to temperature changes. Thermistor 31 is not self-heated and is located on the circuit board panel box 19. The bias supplied to differential amplifier 29 is determined by the ratio of the resistors R6 and R7 and therefore is not effected by temperature. Hence, the output from the amplifier circuit of FIG. 5 will always be at 5 volts at the correct sample gas flow rate. One of the advantages of this approach is that no adjustments are required to the IFD system to compensate for temperature changes over prolonged operation periods. The output from the amplifier of FIG. 5 will always be 5 volts at the designed flow rate sample gas air velocity at which the dissipation constants of the two thermistors 26 and 27 are equal. To assure this operating condition, the flow adjusting screw 25 is provided in the bypass flow path for the sample gas so that the fraction of the total flow passing the flow sensing thermistor 26 readily can be adjusted.

Figure 2:
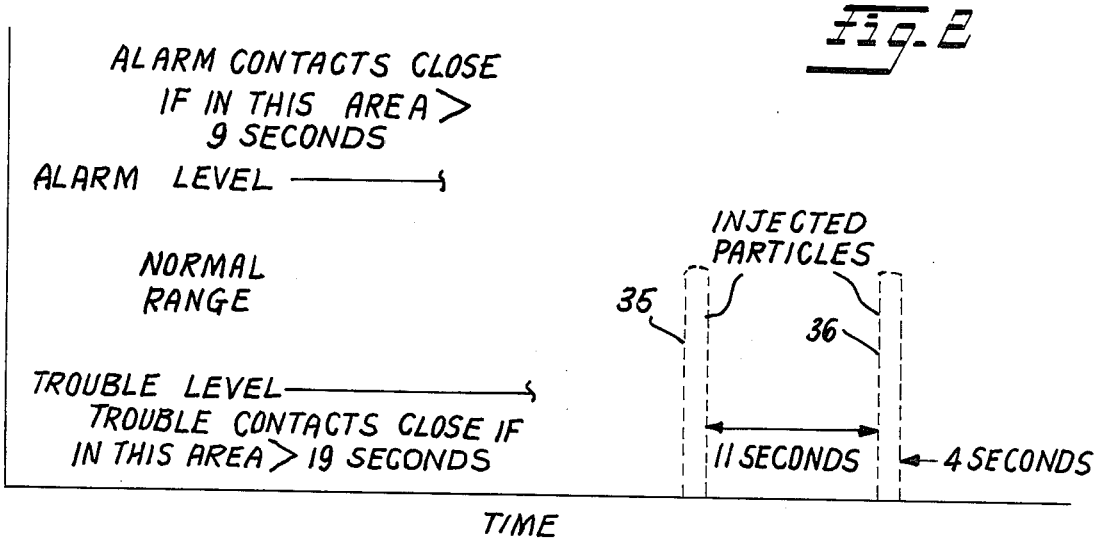
FIG. 2 is an operating characteristic curve for the IFD shown in FIG. 1 in which small particle count versus time is plotted along with alarm and trouble indicating levels for purposes of illustration.

As noted earlier in this disclosure, the IFD includes a number of diagnostic and trouble indicating circuits which are mounted within the control panel 19. One of the trouble indicating functions that is required, is the need to signal the user of the IFD in the event of equipment failure on the part of the Wilson cloud chamber particle detector 11 for any number of different reasons. Upon occurrence of an equipment failure whereby the background small particle count output signal derived by photocell 15 and the output processing circuitry in control panel 19, drops below a certain level, a trouble signal indication is triggered. Such a condition is illustrated in FIG. 2 of the drawings which plots particle level or concentration as the ordinate and time as the abscissa. From FIG. 2 it will be seen that the particle count indicating signal derived from the Wilson cloud chamber particle detector 11 must drop below the trouble level setting for a period in excess of 19 seconds before a trouble indicating signal is triggered. The existence of this trouble level setting can and does cause false trouble indications with the IFD when it is used in low particle level background environments such as clean rooms, computer rooms, and the like. In these environments, the background particle count developed by the Wilson cloud chamber particle detector 11 may drop so low that it goes below the indicated trouble level setting for the reset 19 second interval thereby triggering a trouble signal indicating trouble in the operation of the equipment when in fact there is none but instead only a low background particle count condition.

To obviate the above-briefly described problem, the IFD shown in FIG. 1 includes a particle generator sub-system 32 that is coupled in parallel with the sample gas conduit connecting the output from the selector valve manifold 13 to the input of the Wilson cloud chamber particle detector 11. The particle generator sub-system 32 is controlled by a solenoid valve 33 that in turn is electrically controlled by the central timing control circuit 22 which serves to synchronize operation of the solenoid valve 33 with the opening and closing of the selector valve assembly 12 by the selector valve control circuit 21.

Figure 6:
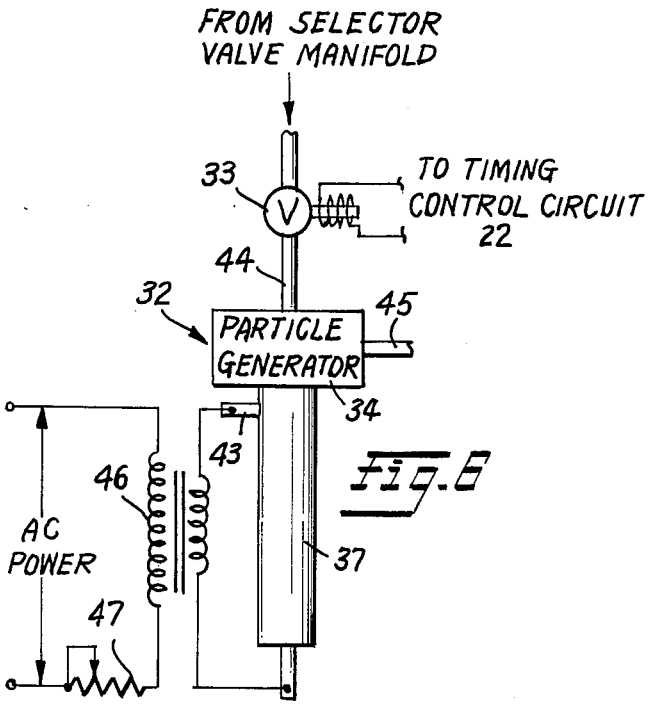
FIG. 6 is a functional block diagram of a novel, controllable, small particle source subsystem employed in the IFD of FIG. 1.

FIG. 6 is an enlarged, partial schematic diagram of the particle generator sub-system and shows the solenoid valve 33 connected in a conduit from the selector valve manifold 13 to an input of the particle source element 34 of the overall particle generator sub-system 32. The particle generator sub-system 32 is designed to inject a relatively high concentration of small particles into the sample gas being supplied to the inlet valving system of the Wilson cloud chamber particle detector 11 over a 4 second interval at the end of each 15 second zone sampling period as described earlier in the disclosure. This action is depicted in FIG. 2 at 35 and 36 in dotted lines. The particle injection shown at 35 would be for a 4 second interval at the end of the preceding 15 second interval while the air sample from one of the zones is being monitored by the particle detector 11. The injection period 36 is the next injection period coming at the end of the next sequential 15 second zone monitoring interval by particle detector 11. This technique is employed because the use of a continuous source of low concentration background particles is very difficult to apply due to problems associated with generating a stable background low particle concentration. In any such arrangement, should the particle concentrations become too high it would affect the alarm calibration of the overall IFD system, or even cause a false alarm.

The above-discussed problem is obviated by use of the operation condition checking sub-system illustrated in FIGS. 1 and 6, and operationally depicted at 35 and 36 of FIG. 2. Four zones are sampled sequentially for 15 seconds each. There is a built-in alarm delay of about 7 seconds to allow for settling and a 2 second blanking interval at the start of each zone sampling interval to reset the delay and thereby prevent an alarm on one zone from effecting following zones. Thus, in FIG. 2 it is seen that a concentration of particles sufficient to exceed the alarm level indicated in FIG. 2, must endure for a period of at least 9 seconds before an alarm is sounded indicating the existence of an alarm condition, i.e. excessive particle count greater than the concentration corresponding to the alarm level.

The injected particles for the periods indicated at 35 and 36 should be tailored to exceed the trouble level and preferably be less than the alarm level, but even that is not critical. An injection of particles by particle generator 3 for the 4 second interval as shown at 35 and 36 of a small particle in excess of the alarm level still would not operate or cause a false alarm. This is due to the fact that the higher level of concentration of particles exists for only a 4 second interval at the end of any one of the zone sampling 15 second intervals. What does occur that is of value, however, is that the large concentration of small particles injected for 4 seconds at the end of each 15 second zone sampling interval as shown at 35 and 36 clearly provides an indication during each zone sampling interval of 15 seconds that the equipment is in proper operating condition. This is particularly useful in low particle background environments such as clean rooms, computer rooms, and the like where there is a real possibility that the normal particle background level would drop below the trouble level setting shown in FIG. 2. In absence of the periodic injections such as shown at 35 and 36, the low particle concentration condition could continue for the full 19 seconds required to close the trouble indicating contacts that signal the existence of an equipment trouble condition.

Figure 7:
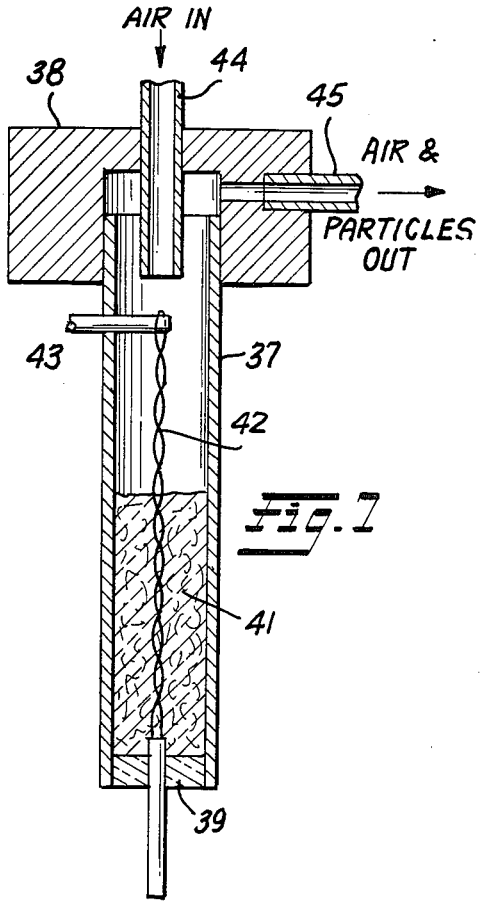
FIG. 7 is a longitudinal sectional view of a novel small particle generator element employed in the small particle source sub-system of FIG. 6.

Various particle generators can be used which are known to the art. For example, electric arc, chemical or thermal particle generators and the like could be used. A preferred particle source element 34 for use in the system of FIGS. 1 and 6 is illustrated in FIG. 7 of the drawings. The particle source element shown in FIG. 7 is comprised by a liquid gas-tight tubular housing 37 of metal and which is closed at the upper end with an enlarged stopper 38 and at the lower end with a smaller stopper 39. The tubular housing 37 is partially filled with a fibrous material, such as glass wool 41, which is saturated with silicon oil. A twisted, dual strand heated filament of michrome or other comparable material 42 is supported in the lower end of the tubular housing by stopper 39 and extends through the silicon saturated glass wool and is supported at the upper end by a support pin 43. A sample atmosphere inlet passage 44 is formed in the center of the large upper stopper 38 and extends down into the interior of tubular housing 37 to a position just above the support pin 43 for twisted dual strand heated filament 42. An outlet passageway 45 is formed in the periphery of the upper stopper 38 and extends radially outward substantially at right angles to the axis of the inlet opening 44. The twisted, dual strand heated filament 42 is continuously supplied heating current from a source of alternating current power as shown in FIG. 6 via a transformer 46 and rheostat 47.

With the above arrangement, the timing circuit 22 opens solenoid valve 33 for about 3–4 seconds at the end of each 15 second zone sampling interval, thereby allowing a burst of small particles to enter the particle detector 11. Because the duration of the burst of particles is less than the alarm delay of 9 seconds, the injected particles will not affect the alarm calibration, even if their concentration exceeds the alarm concentration setting. The important design features of the particular particle source element shown in FIG. 7 of the drawings are as follows: The feature of directing incoming air downwardly into the source through a nozzle-like inlet 44. The feature of a twisted dual strand filament which tends to provide capillary action with respect to the heated silicon oil with which the glass wool 41 is saturated; and the feature of fairly close control over the length of the exposed filament 42 above the level of the silicon oil saturated glass wool 41. The source concentration is controlled by the rheostat 47 shown in FIG. 6 which adjusts the value of the current supplied through the twisted filament 42. If desired for greater stability, an alternating current regulated power supply could be used in place of the rheostat 47 and transformer 46. With the particle source element 34, the rate of silicon oil loss is about 10 mg per month. About 1 gm of oil is used so that the projected operating life of the particle source element is about 100 months.

Figure 8:
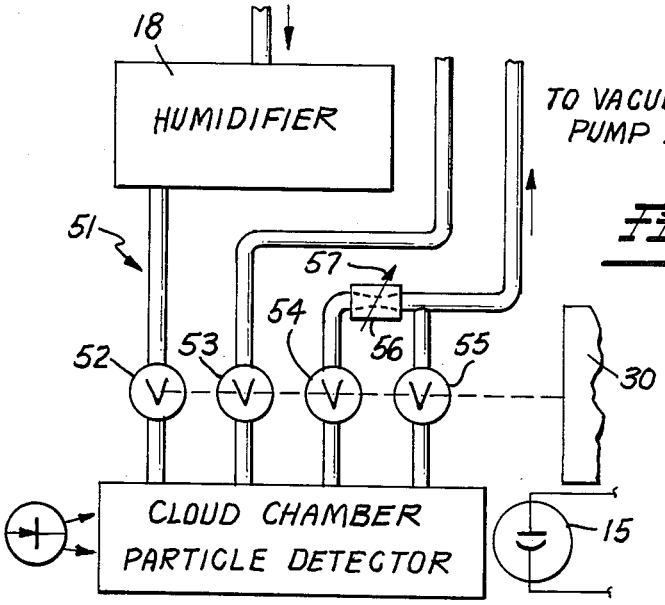
FIG. 8 is a schematic functional block diagram of a new and improved Wilson cloud chamber type particle detector inlet and outlet valving system comprising a part of the improved IFD shown in FIG. 1.

As noted earlier in the description, in the particle detector 11, the sample air supplied from the selector valve manifold 13 is humidified in humidifier 18 and supplied through an improved inlet/outlet valving arrangement for the Wilson cloud chamber type particle detector 11. This improved inlet/outlet valving operation then operates to perform an expansion in the cloud chamber of detector 11 which cools the air sample and causes water to condense on small particles contained in the sample thereby forming droplets of water which are easily detected by the optical system comprised by LED light source 14 and photocell 15. The improved inlet/outlet valving system for the cloud chamber particle detector 11 is shown generally at 51 in FIG. 1 and FIG. 8 of the drawings. As best shown in FIG. 8, the improved inlet/outlet valve cycling system is comprised by first and second inlet valves 52 and 53 connected to the inlet of the main body of the Wilson cloud chamber particle detector 11 and first and second outlet valves 54 and 55 which are connected to the outlet from the cloud chamber particle detector 11. The first inlet valve 52 is connected in series relationship with humidifier 18 as shown in FIG. 8 and FIG. 1 of the drawings. The second inlet valve 53 is connected in parallel circuit relationship with the series connected first inlet valve 52 and humidifier 18 so as to by-pass the humidifier. The first outlet valve 54 is connected in series relationship with a flow restrictor 56 and the second outlet valve 55 is connected in parallel with the first outlet valve 54 and series connected flow restrictor 56 so as to by-pass the first outlet valve 54 and flow restrictor 56.

Figure 9:
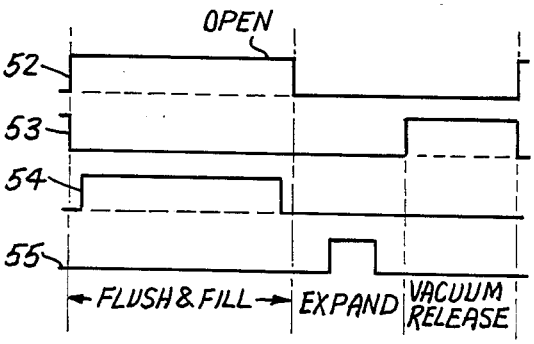
FIG. 9 is a series of operating characteristic curves for the novel cloud chamber inlet and outlet valving system illustrated in FIG. 8.

FIG. 9 is a series of characteristic operating curves showing the periods of time for the opening and closing of the new and improved cloud chamber inlet/outlet valve cycling system 51. Curve 9A illustrates the time during which the first inlet valve 52 is open during an operating cycle of the Wilson cloud chamber particle detector 11. Curve 9B illustrates a portion of the cycle during which the second inlet valve 53 is open. Curve 9C illustrates the period of time during which the first outlet valve 54 is open and flow restrictor 56 is included in the conduit system supplying the cloud chamber 11 and Curve 9D illustrates a suitable time when the second outlet valve 55 is open.

During the flush and fill portions of an operating cycle of the cloud chamber detector 11, both first inlet valve 52 and first outlet valve 54 are open concurrently with the flow through the cloud chamber 11 being regulated by the fill restrictor 56 as shown in FIGS. 9(A) and 9(C). After a short dwell interval, the second outlet valve 55 opens momentarily as shown at 9(D) to reduce the pressure of cloud chamber 11 and thereby create an expansion of the atmosphere in cloud chamber 11. The reduced pressure as the result of the expansion in the cloud chamber then is released by the second inlet valve 53 being opened as shown in FIG. 9(B) through a passage which by-passes the humidifier 18. This improved inlet/outlet valve cycling system differs from prior art arrangements which generally included only the first inlet valve 52 and humidifier 18 and a single outlet valve having a flow restrictor incorporated within the valve itself.

The advantages of the new and improved cloud chamber inlet/outlet valve cycling system 5 are:

(1) With the flow restrictor not part of the valve, it can be made adjustable as indicated by the arrow 57. In prior art inlet/outlet valving schemes the flow restriction was comprised by a narrow groove on a rotary valve which could become clogged with wear debris from the valve after a period of usage thereby modifying flow characteristics through the cloud chamber.

(2) By-passing the humidifier 18 to release the vacuum at the end of the expansion via the second inlet valve 53 prevents a sudden rush of moist air from the humidifier which can entrain water droplets. Also, by allowing unhumidified air to enter the cloud chamber following each expansion cycle prevents the condensation of water on the chamber walls and on the optics.

In any given design, the inlet and outlet valves can take different forms. Inlet and outlet valves can be electrically or pneumatically operated, they can be cam driven, poppet or rotary valves or they can be any other similar known valving devices. In the preferred construction of the incipient fire detector herein disclosed, rotary valves are employed for the cloud chamber inlet and outlet valves 52–55.

From the foregoing description, it will be appreciated that the new and improved incipient fire detector made available by the invention contains a number of improved structural and operating features and advantages that make the IFD simpler to install and operate and more reliable in operation. Because of these new features and advantages, the-improved IFD in operation is less affected by high air velocity, dust, humidity and a wide range of temperature variations, and is less susceptible to the production of false trouble signals. Further, the improved IFD features render it particularly suitable for use in low particle background environments such as clean rooms, computer facilities, and the like.

The new and improved IFD monitors four zones using a sub-micrometer particle detector of the Wilson cloud chamber type. Sampling lines for each zone can have up to ten sampling heads per zone and can be fabricated from plastic tubing, stainless steel pipe or other comparable materials. The sampling system delivers air samples from each of the zones to the particle detector at a continuous flow rate of about 14 liters a minute. Each zone conduit line is sampled sequentially by an electronically controlled selector valve assembly for 15 seconds per zone with all four zones being sampled once a minute. The cloud chamber particle detector operates at a cycling rate of about once per second and provides a continuous analog voltage corresponding to particle concentration in the air samples from the zones being monitored.

The alarm sensitivity for the IFD can be different for each zone being monitored and can be changed with time by means of an external timer to provide increased sensitivity at night, for example. A pre-alarm warning is provided for each zone with the alarm and warning states indicated by separate lights and alarm contact closures for each zone. In addition, the IFD incorporates several diagnostic circuits to monitor its operations, and in case of a problem, a trouble signal is produced that readily can be observed at a centrally disposed control panel. In addition, a diagnostic light mounted on the panel also comes on to indicate the source of the problem.

The small sub-micrometer sized particles detected by the IFD are produced in very large numbers as material is heated, even before visible smoke is produced. Smaller than the wavelength of light, they are invisible even at high concentrations. Hence, a room can contain hundreds of thousands of these small particles to a cubic centimeter, and the air will still appear perfectly clear to the human eye. However, in the particle detector, the sampled air from the several zones is humidified, and then expanded. The expansion cools the air sample and causes water to condense on the small particles entrained in the sample, forming droplets of water around the small particles as centers of condensation which are readily detected by the electro-optical system that comprises a part of the Wilson cloud chamber type particle detector.

INDUSTRIAL APPLICABILITY

The improved incipient fire detector comprising the present invention makes available to industry, commercial facilities, hospitals, schools and other similar institutions an ultra-sensitive fire detector using small particle detection technology to solve many of the fire detection problems confronting such institutions. The incipient fire detector employs a Wilson cloud chamber particle detection system and a novel continuous on-the-fly air sampling system. The air sampling system continuously samples a plurality of zones using sample heads fabricated from tamperproof steel pipe and steel pipe sampling lines for institutions such as jails, or all plastic sample heads and sampling lines used in areas where metal cannot be used or permitted. Typical installations where the advantages of the IFD make it well suited include power plants, museums, nuclear research sites, special test chambers, clean rooms, computer rooms, correctional facilities, and HVAC ducts, and other similar facilities and installations where the IFD's extreme versatility provides reliable fire detection in both normal and hostile environments. It also can be used in environments where the IFD's small, inconspicuous sample heads and sampling conduits system cause minimal disturbance to the original architecture of a building.

Having described one embodiment of a new and improved incipient fire detector constructed in accordance with the invention, it is believed obvious that other modifications and variations of the invention will be suggested to those skilled in the art in the light of the above teachings. It is therefore to be understood that changes may be made in the particular embodiment of the invention described which are within the full intended scope of the invention as defined by the appended claims.

What is claimed is:

1. A new and improved incipient fire detector having sample gas selector valve and conduit system means for selectively sampling the gaseous atmospheres in a multiplicity of different volumetric spaces automatically and sequentially supplying the sampled gases to a centrally located small particle detector, said gaseous atmosphere sampling conduit system including an improved gas sample flow rate deviation detector which operates in a stable manner over a wide range of temperatures to detect any variation in flow rate of the sampled gases through the sampling conduct system from a preset norm, and wherein said gas flow rate deviation detector comprises a pair of self-heating thermistors each having the same resistance value at a known reference temperature but which have different free air dissipation constants, the thermistor with the smaller free air dissipation constant being physically mounted in the gaseous atmosphere sampling conduit system for monitoring the flow rate therethrough and the remaining thermistor being physically mounted in a region that is at the same temperature as the gaseous atmosphere being sampled but is not in a flowing stream of sampled gas, and both thermistors being electrically interconnected in a measurement circuit for deriving an output signal indicative of any deviation in the sampling flow rate of the sampled gaseous atmospheres from a preset norm, and an improved system operating condition checking sub-system comprised by particle generator means connected to the automatically operated sample gas selector valve and conduit system means for selectively injecting small particles into the samples of gaseous atmospheres supplied to the centrally located particle detector that periodically operates to sequentially sample and test the sample gases from the respective zones for the presence of particles, timing and control means coupled to the particle generator means and synchronized with the operation of the respective zone sampling periods for activating the particle generator means for a short time interval relative to the sampling period of each respective zone at the end thereof for injecting into the sample conduit system for delivering a burst of small particles to the centrally located particle detector whereby continued normal operation of the system can be indicated in low particle background environments.

2. A new and improved incipient fire detector according to claim 1 having a centrally located particle detector and wherein the particle detector comprises an improved Wilson Cloud Chamber particle detector having an improved inlet and outlet cloud chamber valving system for sequential supply of the gaseous samples to the cloud chamber for detection of particles therein, said improved inlet and outlet valving system comprising a first cloud chamber inlet valve for supply of gas samples to the cloud chamber through a humidifier via the sample gas selector valve and gas conduit system means, a second cloud chamber inlet valve bypassing the first cloud chamber inlet valve and humidifier, a first cloud chamber outlet valve in series with a flow restriction intermediate the output from the cloud chamber and a cloud chamber vacuum pump, and a second cloud chamber outlet valve bypassing the first cloud chamber outlet valve and series connected flow restriction, and cloud chamber inlet and outlet valve control means for sequentially opening the first inlet and the first outlet cloud chamber valves during a flush and fill cycle and thereafter closing them, after a short dwell time opening the second outlet valve momentarily and then closing it to reduce the pressure in the cloud chamber to create an expansion of the gaseous sample in the cloud chamber, and then releasing the reduced pressure in the cloud chamber by opening the second inlet valve before initiating a new cycle of operation of the cloud chamber.

3. An incipient fire detector according to claim 1 wherein the flow rate sensing thermistor is positioned in a bypass conduit section that parallels a portion of the main sampling conduit system and which further includes a flow rate adjusting means in the bypass conduit section for adjusting the fraction of the total gas flow passing the flow rate sensing thermistor.

4. An incipient fire detector according to claim 3 further including output amplifier circuit means connected in the output from the centrally located particle detector which further includes a third thermistor for varying the gain of the output amplifier circuit means with changes in ambient operating temperature to thereby compensate for varying gain of the flow rate deviation detector circuit with changes in temperature and maintaining constant output from the output amplifier circuit means at the adjusted normal flow rate despite changes in ambient operating temperature.

5. An incipient fire detector according to claim 4 wherein the timing and control means includes an electrically operated solenoid valve means connected in a bypass portion of the sample gas conduit system for diverting a portion of the sample gas into the inlet end of the particle generator means with the outlet end of the particle generator means being connected to the input of the centrally located particle detector, and wherein a central controller controls operation of the electrically operated solenoid valve means synchronously with the automatically operated selector valve system for delivering samples of the gaseous atmospheres from each of the zones selectively and sequentially to the centrally located particle detector.

6. An incipient fire detector according to claim 5 wherein the particle generator means is comprised by a closed tubular liquid and gas-tight housing partially filled with a fibrous material such as glass wool saturated with silicon oil, a twisted dual strand heated filament is secured on one end of the tube and extending through the saturated glass wool to a location above the wool and oil, a sample atmosphere inlet passage is formed in the remaining end of the tube and extends down into the tube to a position above the free end of the twisted heated filament, and an outlet passageway is formed in the same end of the tube as the inlet passageway at a point intermediate the end of the tube and the downwardly extending end of the inlet passageway and extends radially outward substantially at a right angle to the longitudinal axis of the tube.

7. An incipient fire detector according to claim 6 wherein each zone is sampled for a sample interval of the order of 15 seconds in sequence with the other zones and wherein an alarm condition caused by the detection of excessive particles in excess of an alarm level in each zone being sampled must continue for a predetermined alarm interval of the order of 9 seconds, a trouble condition rendering the incipient fire detector inoperative must persist for a predetermined trouble interval of the order of 19 seconds and a burst of test particles is injected by the particle generator means into the sample conduit system for an interval of the order of the last 4 seconds of the 15 second sample interval for each zone whereby no false alarm is caused by the injection of the test particles nor is a false condition allowed to be indicated in low particle concentration environments in the absence of a true equipment failure.

8. An improved incipient fire detector according to claim 2 wherein the flow restriction in series with the first cloud chamber outlet valve is adjustable to different values of flow resistance.

9. An improved incipient fire detector according to claim 8 wherein the cloud chamber inlet and outlet valves are either electrically controlled, pneumatically controlled, cam driven poppet or rotary valves.

10. An incipient fire detector according to claim 9 wherein each zone is sampled for a sample interval of the order of 15 seconds in sequence with the other zones and wherein an alarm condition caused by the detection of excessive particles in excess of an alarm level in each zone being sampled must continue for a predetermined alarm interval of the order of 9 seconds, a trouble condition rendering the incipient fire detector inoperative must persist for a predetermined trouble interval of the order of 19 seconds and a burst of test particles is injected by the particle generator means into the sample conduit system for an interval of the order of the last 4 seconds of the 15 second sample interval for each zone whereby no false alarm is caused by the injection of the test particles nor is a false condition allowed to be indicated in low particle concentration.

11. An incipient fire detector according to claim 10 wherein the timing and control means comprises an electrically operated solenoid valve means connected in a bypass portion of the sample gas conduit system for diverting a portion of the sample gas into the inlet end of the particle generator means with the outlet end of the particle generator means being connected to the input of the centrally located particle detector, and wherein a central controller controls operation of the electrically operated solenoid valve means synchronously with the automatically operated selector valve system for delivering samples of the gaseous atmospheres from each of the zones selectively and sequentially to the centrally located particle detector.

12. An incipient fire detector according to claim 11 wherein the particle generator means is comprised by a closed tubular liquid and gas-tight housing partially filled with a fibrous material such as glass wool saturated with silicon oil, a twisted dual strand heated filament is secured on one end of the tube and extends through the saturated glass wool to a location above the wool and oil, a sample atmosphere inlet passage is formed in the remaining end of the tube and extends down into the tube to a position above the free end of the twisted heated filament, and an outlet passageway is formed in the same end of the tube as the inlet passageway at a point intermediate the end of the tube and the downwardly extending end of the inlet passageway and extends radially outward substantially at a right angle to the longitudinal axis of the tube.

13. An improved incipient fire detector according to claim 12 wherein the flow rate sensing thermistor is positioned in a bypass conduit section that parallels a portion of the main sampling conduit system and which further includes a flow rate adjusting means in the bypass conduit section for adjusting the fraction of the total gas flow passing the flow rate sensing thermistor.

14. An improved incipient fire detector according to claim 13 further including output amplifier circuit means connected in the output from the centrally located particle detector which further includes a third thermistor for varying the gain of the output amplifier circuit means with changes in ambient operating temperature to thereby compensate for varying gain of the flow rate deviation detector circuit with changes in temperature and maintaining constant output from the output amplifier circuit means at the adjusted normal flow rate despite changes in ambient operating temperature.

15. In a new and improved incipient fire detector having means for selectively sampling the gaseous atmospheres in a multiplicity of different volumetric spaces on a sequential basis and supplying the sampled gases via a selector valve and conduit system to a centrally located sensor, said gaseous atmosphere sampling conduit system including an improved gas flow rate deviation detector which operates in a stable manner over a wide range of temperatures to detect any variation in flow rate of the sampled gases through the sampling conduit system from a preset norm, and wherein said gas flow rate deviation detector comprises a pair of self-heating thermistors each having the same resistance value at a known reference temperature but which have different free air dissipation constants, the thermistor with the smaller free air dissipation constant being physically mounted in the gaseous atmosphere sampling conduit system for monitoring the flow rate therethrough and the remaining thermistor being physically mounted in a region that is at the same temperature as the gaseous atmosphere being sampled but is not in a flowing stream of sampled gas, and both thermistors being electrically interconnected in a measurement circuit for deriving an output signal indicative of any deviation in the sampling flow rate of the sampled gaseous atmospheres from a preset norm.

16. An improved flow rate deviation detector according to claim 15 wherein the flow rate sensing thermistor is positioned in a bypass conduit section that parallels a portion of the main sampling conduit system and which further includes a flow rate adjusting means in the bypass conduit section for adjusting the fraction of the total gas flow passing the flow rate sensing thermistor.

17. An improved flow rate deviation detector according to claim 15 further including output amplifier circuit means connected in the output from the centrally located sensor which further includes a third thermistor for varying the gain of the output amplifier circuit means with changes in ambient operating temperature to thereby compensate for varying gain of the flow rate deviation detector with changes in temperature and maintaining constant output from the output amplifier circuit means at the adjusted normal flow rate despite changes in ambient operating temperature.

18. An improved flow rate deviation detector according to claim 16 further including output amplifier circuit means connected in the output from the centrally located sensor which further includes a third thermistor for varying the gain of the output amplifier circuit means with changes in ambient operating temperature to thereby compensate for varying gain of the flow rate deviation detector with changes in temperature and maintaining constant output from the output amplifier circuit means at the adjusted normal flow rate despite changes in ambient operating temperature.

19. In a new and improved incipient fire detector intended for use in clean rooms and other low particle background environments, an improved system operating condition checking sub-system comprised by particle generator means connected to a sample gas conduit and automatically operated selector valve system for sequentially supplying samples of the gaseous atmospheres of a plurality of zones being monitored to a centrally located particle detector type sensor that periodically operates to sequentially sample and test the sample gases from the respective zones for the presence of particles, timing and control means coupled to the particle generator means and synchronized with the operation of the respective zone sampling periods for activating the particle generator means for a short time interval relative to the sampling period of each respective zone at the end thereof for injecting into the sample conduit system a burst of particles for detection for delivery to the centrally located particle detector type sensor whereby continued normal operation of the system can be indicated in low particle background environments.

20. An improved system operating condition checking sub-system for an incipient fire detector according to claim 19 wherein each zone is sampled for a sample interval of the order of 15 seconds in sequence with the other zones and wherein an alarm condition caused by the detection of excessive particles in excess of an alarm level in each zone being sampled must continue for a predetermined alarm interval of the order of 9 seconds, a trouble condition rendering the incipient fire detector inoperative must persist for a predetermined trouble interval of the order of 19 seconds and a burst of test particles is injected by the particle generator means into the sample conduit system for an interval of the order of the last 4 seconds of the 15 second sample interval for each zone whereby no false alarm is caused by the injection of the test particles nor is a false trouble condition allowed to be indicated in low particle concentration environments in the absence of a true equipment failure.

21. An improved system operating condition checking sub-system according to claim 19 wherein the particle generator means is comprised of a closed tubular liquid and gas-tight housing partially filled with a fibrous material such as glass wool saturated with silicon oil, a twisted dual strand heated filament secured in one end of the tube and extending through the saturated glass wool to a location above the wool and oil, a sample atmosphere inlet passage is formed in the remaining end of the tube and extends down into the tube to a position above the free end of the twisted heated filament, and an outlet passageway is formed in the same end of the tube as the inlet passageway at a point intermediate the end of the tube and the downwardly extending end of the inlet passageway and extends radially outward substantially at a right angle to the longitudinal axis of the tube.

22. An improved system operating condition checking sub-system according to claim 19 wherein the timing and control means comprises an electrically operated solenoid valve means connected in a bypass portion of the sample conduit system for diverting a portion of the sample gas into the inlet end of the particle generator means with the outlet end of the particle generator means being connected to the input of the centrally located particle detector type sensor, and wherein a central controller controls operation of the electrically operated solenoid valve means synchronously with the automatically operated selector valve system for delivering samples of the gaseous atmospheres from each of the zones selectively and sequentially to the centrally located particle detector type sensor.

23. An improved system operating condition checking sub-system according to claim 20 wherein the particle generator means is comprised of a closed tubular liquid and gas-tight housing partially filled with a fibrous material such as glass wool saturated with silicon oil, a twisted dual strand heated filament secured in one end of the tube and extending through the saturated glass wool to a location above the wool and oil, a sample atmosphere inlet passage is formed in the remaining end of the tube and extends down into the tube to a position above the free end of the twisted heated filament, and an outlet passageway is formed in the same end of the tube as the inlet passageway at a point intermediate the end of the tube and the downwardly extending end of the inlet passageway and extends radially outward substantially at a right angle to the longitudinal axis of the tube.

24. An improved system operating condition checking sub-system according to claim 23 wherein the timing and control means comprises an electrically operated solenoid valve means connected in a bypass portion of the sample conduit system for diverting a portion of the sample gas into the inlet end of the particle generator means with the outlet end of the particle generator means being connected to the input of the centrally located particle detector type sensor, and wherein a central controller controls operation of the electrically operated solenoid valve means synchronously with the automatically operated selector valve system for delivering samples of the gaseous atmospheres from each of the zones selectively and sequentially to the centrally located particle detector type sensor.

25. In a new and improved incipient fire detector having means for selectively sampling the gaseous atmospheres in a multiplicity of different volumetric spaces on a sequential and continuous periodic basis and supplying the sampled gases via a sample selector valve and gas conduit system to a centrally located particle detector type sensor, and wherein the particle detector comprises an improved Wilson Cloud Chamber particle detector having an improved inlet and outlet cloud chamber valving system for sequential supply of the gaseous samples to the cloud chamber for detection of particles therein, said improved inlet and outlet valving system comprising a first cloud chamber inlet valve for supply of gas samples to the cloud chamber through a humidifier via the sample gas selector valve and gas conduit system means, a second cloud chamber inlet valve bypassing the first cloud chamber inlet valve and humidifier, a first cloud chamber outlet valve in series with a flow restriction intermediate the output from the cloud chamber and the cloud chamber vacuum pump, and a second cloud chamber outlet valve bypassing the first cloud chamber outlet valve and series connected from resistance, and cloud chamber inlet and outlet valve control means for sequentially opening the first inlet and the first outlet cloud chamber valves during a flush and fill cycle and thereafter closing them, after a short dwell time opening the second outlet valve momentarily and then closing it to reduce the pressure in the cloud chamber to create an expansion of the gaseous sample in the cloud chamber, and then releasing the reduced pressure by opening the second inlet valve before initiating a new cycle of operation of the cloud chamber particle detector.

26. An improved inlet and outlet valving system for a Wilson cloud chamber type particle detector according to claim 25 wherein the flow restriction in series with the first cloud chamber outlet valve is adjustable to different values of flow resistance.

27. An improved inlet and outlet valving system for a Wilson cloud chamber type particle detector according to claim 25 wherein the cloud chamber valves are either electrically controlled, pneumatically controlled, cam driven poppet or rotary valves.

28. An improved inlet and outlet valving system for a Wilson cloud chamber type particle detector according to claim 26 wherein the cloud chamber valves are either electrically controlled, pneumatically controlled, cam driven poppet or rotary valves.

* * * * *